United States Patent [19]

Klenk et al.

[11] Patent Number: 5,014,668

[45] Date of Patent: May 14, 1991

[54] METHOD AND SYSTEM FOR ADJUSTING THE LAMBDA VALUE

[75] Inventors: Martin Klenk, Backnang; Ernst Linder, Mühlacker; Winfried Moser, Ludwigsburg, all of Fed. Rep. of Germany

[73] Assignee: Robert Bosch GmbH, Stuttgart, Fed. Rep. of Germany

[21] Appl. No.: 445,857

[22] PCT Filed: Feb. 23, 1989

[86] PCT No.: PCT/DE89/00099

§ 371 Date: Nov. 15, 1989

§ 102(e) Date: Nov. 15, 1989

[87] PCT Pub. No.: WO89/08777

PCT Pub. Date: Sep. 21, 1989

[30] Foreign Application Priority Data

Mar. 16, 1988 [DE] Fed. Rep. of Germany ..... 3808696

[51] Int. Cl.[5] ..... F02D 41/14

[52] U.S. Cl. ..... 123/399; 123/489

[58] Field of Search ..... 123/399, 361, 478, 489

[56] References Cited

U.S. PATENT DOCUMENTS 4,434,768 3/1984 Ninomiya ..... 123/489

4,594,984 6/1986 Raff et al. ..... 123/436 X 4,771,752 9/1988 Nishimura et al. ..... 123/399 X

FOREIGN PATENT DOCUMENTS 272814 6/1988 European Pat. Off. .

3341720 1/1987 Fed. Rep. of Germany .

OTHER PUBLICATIONS

Patent Abstracts of Japan, vol. 10, Nr. 311 (M528) (2367), Oct. 23, 1986 & JP, A, 61123735 (Toyota) 6-1-1-86.

Patent Abstracts of Japan, vol. 11, Nr. 321 (M633) (2768), Oct. 20, 1987 & JP, A, 62103447 (Mazda) 5-1-3-87.

Patent Abstracts of Japan, vol. 12, Nr. 315 (M735) (3162), Aug. 26, 1988 & JP, A, 6388236 (Nissan) 4-1-9-88.

*Primary Examiner*—Tony M. Argenbright

*Attorney, Agent, or Firm*—Michael J. Striker

[57] ABSTRACT

A method and a system for adjusting the lambda value of an air/fuel mixture to be supplied to an internal combustion engine wherein a throttle flap is adjusted in each case in such a manner that lean operation is obtained in a lower load range and a stoichiometric operation (lambda = 1) is obtained in an upper load range.

10 Claims, 3 Drawing Sheets

FIG. 2A
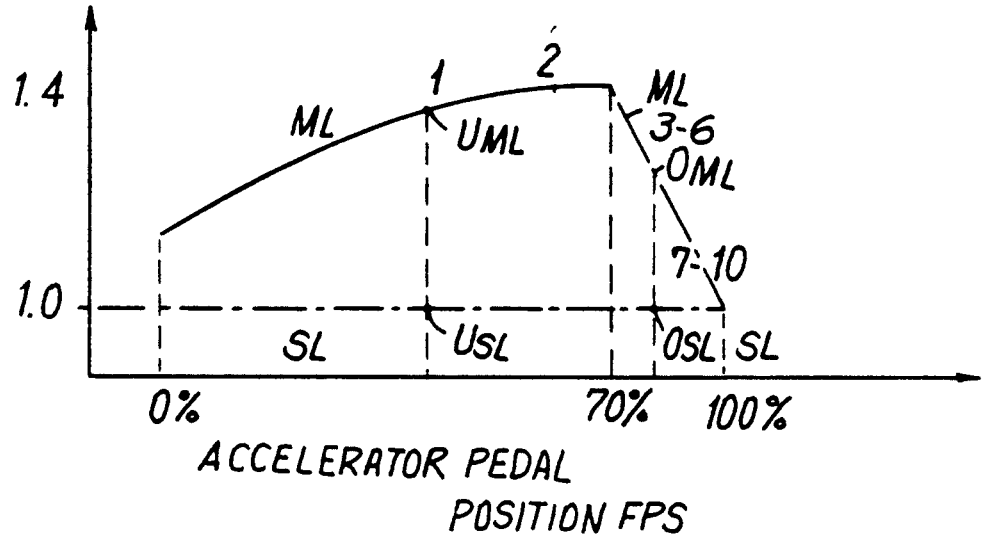
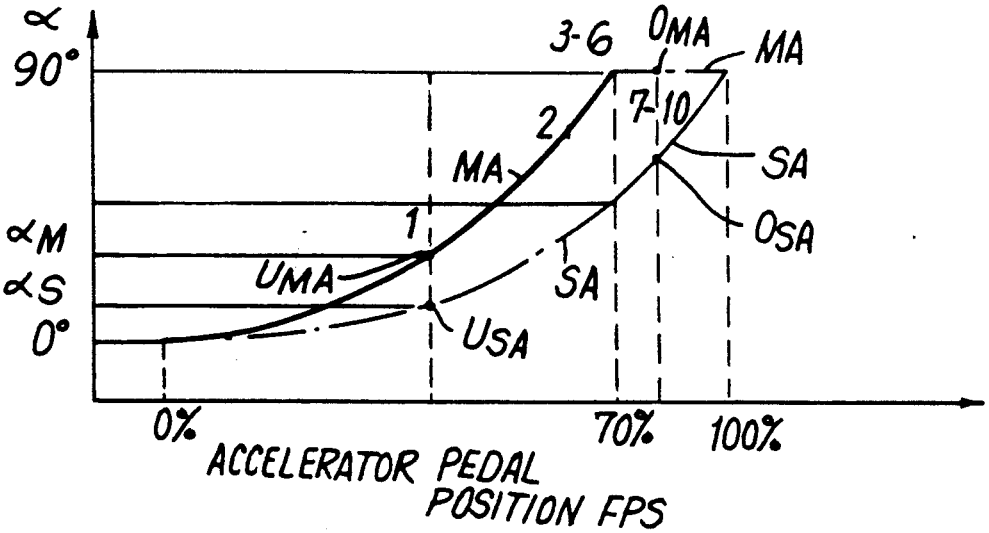
FIG. 2B

METHOD AND SYSTEM FOR ADJUSTING THE LAMBDA VALUE

BACKGROUND OF THE INVENTION

The invention relates to a method and a system for adjusting a lambda value of the air/fuel mixture supplied to an internal combustion engine during the transition from a lower load range to a upper load range.

Such a method and such an adjusting system are known from DE-C2-33 41 720. The system includes an adjusting means which outputs, in dependence on a respective value of a accelerator pedal position signal supplied to it, an adjusting signal to a throttle flap actuator for adjusting the air volume supplied to the internal combustion engine in such a manner that a lean air/fuel mixture is obtained below a position threshold value of the accelerator pedal position signal which marks the boundary between the lower and upper load range. The system operates in such a manner that shortly before the threshold value is reached, the throttle flap is completely open. If, finally, correspondence between the threshold value and the value of the accelerator pedal position signal is achieved, the throttle flap is reset by a predetermined value which can depend on the rotational speed and the accelerator pedal position. The resetting occurs to such an extent that a rich mixture is obtained in the upper load range, even if the throttle flap is again opened further with further increase in the value of the accelerator pedal position signal past the position threshold value.

Operating at a lambda value of less than 1 in the upper load range results in an increased pollutant emission.

SUMMARY OF THE INVENTION

The object of the invention is a method and a system for adjusting the lambda value of an air/fuel mixture supplied to an internal combustion engine during the transition from the lower load range to the upper load range and conversely, which lead to a lower pollutant emission. The object of the invention is achieved by providing a method and a system which enable a throttle flap adjustment, at least at a steady-state operation, in such a manner that a lambda value equal to 1 is obtained for values of the accelerator position exceeding the position threshold value.

The method according to the invention and the adjusting system according to the invention differ from the prior art in that, for values of the accelerator pedal position signal above the position threshold value, at least during steady-state operation, adjusting signals of such a magnitude are output that an essentially stoichiometric mixture is obtained. In the lower load range, that is to say below the position threshold value of the accelerator pedal position signal, lambda values of greater than 1 are thus obtained whilst the lambda value is set to be equal to 1 in the upper load range. Thus, low pollutant values are also achieved in the upper load range in an internal combustion engine which is equipped with a catalytic converter.

The restriction, "at least during steady-state operation" is mentioned with respect to the adjustment of the lambda value. The reason for this restriction lies in the fact that it is possible, in the upper load range just as, incidentally, also in the lower load range, that the accelerator pedal is kept unchanged over relatively long time intervals whilst it is just as well possible that acceleration or deceleration occurs without leaving the range. The former is called steady-state operation and the latter is called non-steady-state operation. As a rule, the period within which several revolutions of the engine occur is considered to be the time interval within which no change in accelerator pedal position should occur and thus steady-state operation is referred to. In the case of non-steady-state operation, the adjustment to lambda equal to 1 can be conveniently disregarded because of the smooth running characteristics usually required.

To achieve good smooth running, the adjusting means according to an advantageous further development includes a transition means which during the transition from an adjusting signal for lean operation to one for stoichiometric operation or conversely produces a gradual transition within a predetermined period of time. This eliminates abrupt changes in torque which can occur if switching were to occur abruptly from lean operation to stoichiometric operation.

Considering the currently used engine electronics which in many cases is controlled by microcomputers, it is of advantage to implement all operational function by functions of such a microcomputer. It is then also of advantage to use an adjusting signal storage which in this case stores a set of adjusting values addressed via values of the accelerator pedal position signal for lean and for stoichiometric operation. If, however, very fast microcomputers are used, the adjusting values can also be calculated via a mathematical relationship from a respective value of the accelerator pedal position signal.

To obtain particularly low pollutant values, it is of advantage to regulate the lambda value, particularly in the case of stoichiometric operation.

The present invention both as to its construction so to its mode of operation, together with additional advantages thereof, will be best understood from the following detailed description of the preferred embodiment with reference to the accompanying drawings.

BRIEF DESCRIPTION OF THE DRAWINGS

FIGS. 2*a* and 2*b* show diagrams, correlated via the accelerator pedal position, relating to the dependence of the lambda value on the accelerator pedal position, and of the throttle flap angle on the accelerator pedal position.

DETAILED DESCRIPTION OF THE PREFERRED EMBODIMENT

Figure 1:
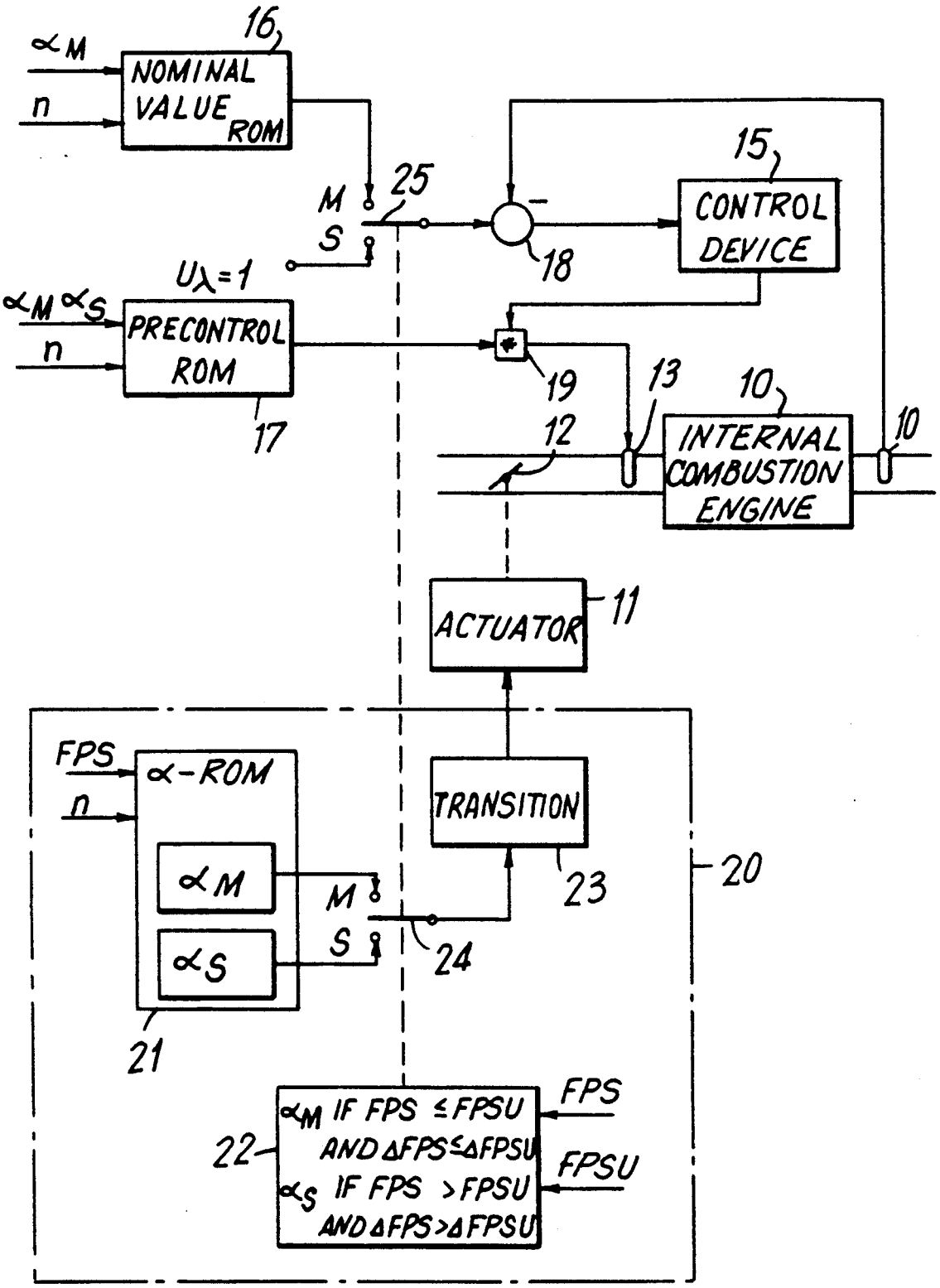
FIG. 1 shows a functional block diagram of an adjusting system.

The operational sequence of an adjusting system, shown in FIG. 1, is used in an internal combustion engine 10 which includes in an intake connector a throttle flap 12 which is adjustable by of a throttle flap actuator 11, and an injection valve 13. A lambda probe 14 is arranged in the exhaust pipe. The adjusting system includes a control means 15, a nominal lambda value ROM 16, a precontrol value ROM 17, a subtraction means 18, a multiplication means 19 and, as a functional means of particular importance to the invention, an adjusting means 20. The latter includes an adjusting signal ROM 21, a comparator means 22, and a transition means 23. The comparator means 22 operates two switches, namely, an adjusting signal switch 24 and a nominal-value switch 25. These switches, too, are usually implemented by sections of a program.

It is initially assumed that the throttle flap 12 is directly adjusted by the accelerator pedal and the nominal-value switch 25 is switched to the lower position in which it provides a nominal value for control of lambda equal to 1, of the subtraction means 18 which, at the same time, is supplied with the voltage from the lambda probe 14 as nominal value. The control means 15 then outputs a control signal to the multiplication means 19, which is there multiplied by a precontrol value for injection time. As a result, the actually required injection time is obtained which is supplied to the injection valve 13. The precontrol value is read out of the precontrol value ROM 17 in dependence on the position of the throttle flap and the rotation speed n. With these assumptions, a conventional, adjusting system is available which controls lambda to be equal to 1.

If it is assumed, as before, that the position of the throttle flap 12 directly depends on the position of the accelerator pedal, and if, in contrast, the nominal-value switch 25 is switched to the top so that it is supplied with a nominal value from the nominal lambda value ROM 16 depending on the throttle flap position and the rotational speed, the system is controlled to the read out nominal value. The read out nominal value leads to a lambda value of greater than 1, that is to say, to a lean control.

In the method and system according to the invention, with the functional combinations of FIG. 1, the throttle flap, in opposition to the above-mentioned assumption, cannot be directly adjusted by the accelerator pedal but the accelerator pedal position signal FPS is supplied to the adjusting means 20 which processes the signal and then outputs an adjusting signal to the throttle flap actuator 11. The operation of the adjusting means 20 will now be explained in greater detail with reference to FIG. 2.

In FIG. 2*a*, the horizontal line, which indicates that the lambda value remains constantly at 1 over the entire range of the accelerator pedal position FPS from 0% to 100%, is shown by dot-dashed portions, as SL between 0% and a position threshold value FPSU 70%, that is to say in the lower load range, and drawn continuously as SL thereafter, that is to say in the upper load range. To obtain a lambda value of 1 with a respective accelerator pedal position FPS, the throttle flap angle $\alpha$, drawn against the accelerator pedal position FPS, must exhibit a variation which is given by the lower curve in FIG. 2*b*. This curve for, stoichiometric operation is also shown by dot-dashed portions in the lower load range and designated by SA' whilst the section located in the upper load range is drawn continuously and is designated by SA.

However, the fact is that the method or adjusting system according to the invention is not used for effecting a stoichiometric adjustment in the overall range but is used for providing lean operation in the lower load range and stoichiometric operation in the upper load range. The curves for lean operation, corresponding to the abovementioned curves for stoichiometric operation are in each case at the top in FIGS. 2*a* and 2*b* as part branches ML and ML' for the lambda value and as part branches MA and MA' for the throttle flap angle. In the case of lean operation, the throttle flap reaches the full opening angle of 90° already with a position threshold value FPSU of 70%. The lambda value achieved at this angle is specified with 1.4 in FIG. 2*a*. If the value of the accelerator pedal position signal FPS is further increased, this leads to an increased fuel supply and thus a decreasing lambda value which is shown by the dot-dashed straight line designated by ML' in FIG. 2*a*. The corresponding dot-dashed horizontal line, which indicates that the throttle flap angle $\alpha$ remains unchanged at 90° in lean operation in FIG. 2*b* is designated by MA'. The curve sections in FIGS. 2*a* and 2*b* which are in the part-load range with lean operation are shown continuous and designated by ML and MA, respectively.

It shall now be assumed that the internal combustion engine 10 is initially operated in steady state with a accelerator pedal position signal FPS of 50%. This value is in the lower load range so that values $U_{ML}$ and $U_{SL}$, respectively, on the respective lean branches ML and MA are used as a basis both for the lambda value and for the throttle flap angle $\alpha$. Now the accelerator pedal is suddenly adjusted at a time $t_B$, which is also drawn in FIG. 3, by such an amount that a accelerator pedal position signal of 80% corresponding to a value in the upper load range is reached. It shall be assumed that the adjusting of the accelerator pedal occurs within a time interval which corresponds to two computing cycles of the adjusting system implemented by a microcomputer. A new computing cycle begins with each ignition process or with a certain phase shift with respect to each ignition process so that the time between two cycle beginnings is about 30 ms with a rotational speed of 3000 rpm in an internal combustion engine having 4 cylinders.

Figure 3A:
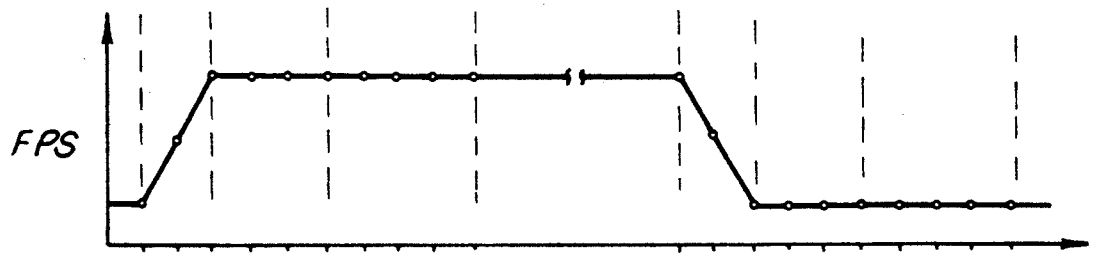
FIGS. 3*a, b* and *c* show time-correlated signal variations of accelerator pedal position, lambda value and throttle flap angles for the transition from a lower load range into an upper load range and conversely.
Figure 3B:
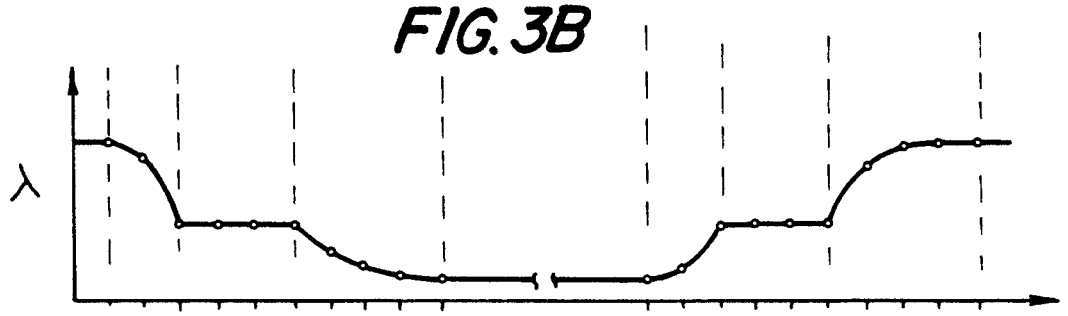
Figure 3C:
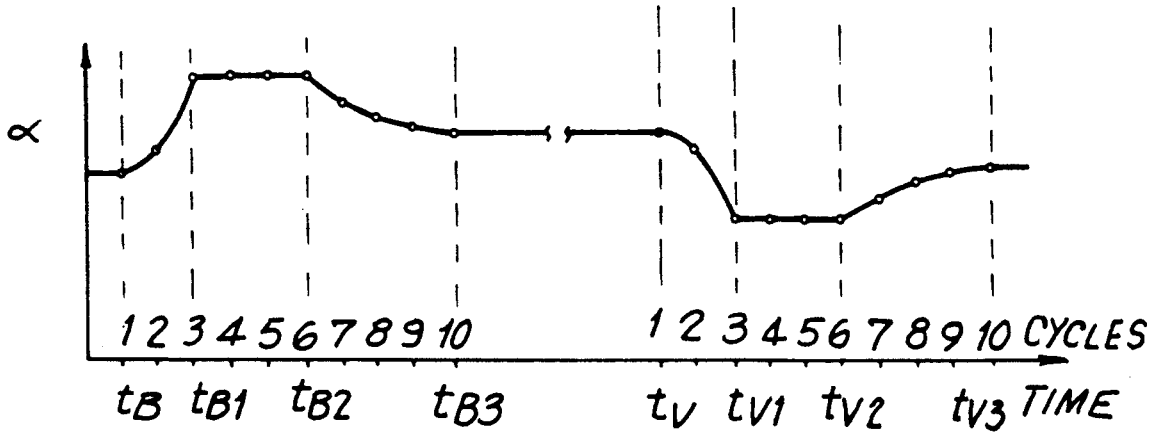

It shall be furthermore assumed that the time $t_B$ at which the acceleration process starts coincides exactly with the beginning of a computing cycle. In FIGS. 2 and 3, this cycle has the number "1". At the beginning of the second computing cycle, the accelerator pedal position signal FPS is still in the lower load range as a result of which the values identified by "2" in FIGS. 2*a* and 2*b* are adjusted to the respective lean branch ML for the lambda value and MA for the throttle flap angle. With the beginning of the third cycle, that is to say after two concluded cycles, as assumed, the accelerator pedal position signal has reached the final value of 80%, which is in the upper load range, at a time $t_{B1}$. In the upper load range, stoichiometric operation is to be carried out in accordance with the prerequisites. The values on the full-load branches SL and SA for the lambda and the throttle flap angle, respectively, drawn with $O_{SL}$ and $O_{SA}$ in FIGS. 2*a* and 2*b*, correspond to stoichiometric operation in the upper load range with a accelerator pedal position signal FPS of 80%. This jump to the values for stoichiometric operation can actually be carried out with suitable internal combustion engines which at the same time barely exhibit a jump in torque. However, in order to achieve a highly smooth running even with internal combustion engines which are critical with respect to smooth-running characteristics, the process is advantageously continued as follows.

After the comparator means 22 has established at the beginning of the third computing cycle that the accelerator pedal position FPS is in the upper load range, it is still unclear whether the position now measured is the final position. This could be a non-steady-state operation in which the accelerator pedal is adjusted further, towards greater or lesser values within the upper load range or even back into the lower load range. In non-steady-state operation, special control conditions frequently apply, for example it has long been usual to perform an acceleration enrichment which is controlled down. Depending on the internal combustion engine present in each case, it can be disadvantageous to superimpose functions for the change from lean operation to stoichiometric operation or conversely on the control functions for non-steady-state operation. The microprocessor therefore checks for four cycles, starting from $t_{B1}$, namely for cycles "3", "4", "5" and "6", whether the fluctuation ΔFPS of the accelerator pedal position signal FPS drops below a predetermined fluctuation range ΔFPSU over the four cycles. If this is found as in the present example, the comparator means 22, that is to say a comparing program step in the usual case, outputs a switching signal to the adjusting signal switch 24 and the nominal value switch 25 for switching from lean operation to stoichiometric operation. It is then no longer the throttle flap angles $\alpha_M$ for lean operation but throttle flap angles $\alpha_S$ for stoichiometric operation which are then read out of the adjusting signal ROM 21 in dependence on the accelerator pedal position FPS and the rotational speed n. The reason for the rotational-speed dependence will be explained below. In addition, it is no longer nominal values for lean control in dependence on throttle flap angles $\alpha_M$ for lean operation and on the rotation speed which are read out of the nominal lambda value ROM 16, but a fixed nominal value for achieving lambda equal to 1 is now read out and the control means 15 controls with the aid of this fixed nominal value.

As a further advantageous development of the functional combinations in an adjusting system, the transition means 23 is provided in the embodiment of FIG. 1. This program step leads to the jump from the throttle flap angle identified by $O_{ML}$ on the dot-dashed lean branch ML' to the throttle flap angle identified by $O_{SL}$ for the same accelerator pedal position signal FPS on the stoichiometric branch SL not being performed with one step, that is to say from one computing cycle to the other, when the comparator means 22 has finally carried out the switching from lean operation to stoichiometric operation at a time $t_{B2}$. Instead, the procedure is such that a jump from a throttle flap angle from 90° to one of about 60° as in the illustrative embodiment is subdivided into four part jumps in the computing cycles "7"–"10", for example into jumps to 75, 65, 62 and finally 60°.

Apart from the values $U_{ML}$ and $U_{MA}$ on the lean branches for the lambda value and the throttle flap angle in FIGS. 2*a* and 2*b*, values $U_{SL}$ and $U_{SA}$ are in each case drawn on the stoichiometric branches in the lower load range, shown with dot-dashed portions, for that accelerator pedal position FPS which also includes the values $U_{ML}$ and $U_{MA}$, respectively. It shall be assumed that the accelerator pedal is suddenly taken back to the original value in the lower load range for deceleration at a later time $t_V$ (FIG. 3) from the position in the upper load range assumed in the acceleration process. The operation of the adjusting system described above is then correspondingly repeated. At the beginning of the second computing cycle (it is again assumed that the accelerator pedal is adjusted in slightly less than 2 cycles), it is now found by the comparator means 22 that a accelerator pedal position signal FPS of less than the position threshold value FPSU is reached, that is to say a value in the lower load range. However, this condition alone is not sufficient for switching from stoichiometric operation to lean operation. Instead, values are still read from the stoichiometric branch from the adjusting signal ROM 21 as before, namely from its section SA' in the lower load range. Only if the fluctuation ΔFPS of the accelerator pedal position signal has again not exceeded the predetermined fluctuation range ΔFPSU over four cycles, switch-over occurs at time $t_{V2}$. In this case, too, the jump with the switch-over is not carried out in one step but the transition from the throttle flap angle $\alpha_S$ read out for the stoichiometric branch SA' to the throttle flap angle $\alpha_M$ for lean operation on the branch MA applicable to the same value of the accelerator pedal position signal FPS occurs within four steps up to time $t_{V3}$.

It has been mentioned above that it is not only in each case a set of values for the relationship between the accelerator pedal position and the throttle flap angle $\alpha_M$ for lean operation and the throttle flap angle $\alpha_S$ for stoichiometric operation which are stored in the adjusting signal ROM 21, but that several sets for different rotational speeds n exist so that the respectively relevant throttle flap angle is read out in dependence on the signal of the comparator means 22, the value of the accelerator pedal position signal FPS and the rotational speed n. The reason is as follows. If an internal combustion engine is operated at high load but low rotational speed, for example when driving the vehicle, in which the internal combustion engine is mounted, uphill, and the accelerator pedal is then moved from a lower load position to an upper load position, the consequence is that, more fuel is delivered because of the usual full-load enrichment but no additional air is taken in since the volume of air which can be taken in is no longer determined by the throttle flap position but by the rotational speed of the engine above a certain throttle flap position. If it is then intended to switch from lean operation to stoichiometric operation, the throttle flap must be, set back by a very great amount for its adjustment to have any effect in reducing the air supply. With a high rotational speed, in contrast, for example during downhill driving and the acceleration into the lower load range which then occurs, a slight reduction of the throttle flap angle will already lead to a reduction in the air volume which can be taken in. This explains that the relationship between the accelerator pedal position and the throttle flap angle is dependent on rotational speed.

It has already been mentioned above that the values for the throttle flap angle, instead of being calculated from a table stored in an adjusting signal memory, can also be calculated from the respective value of the accelerator pedal position. Correspondingly, the rotational speed can be taken into consideration during such a calculation.

For the abovementioned reason, namely that the air volume which can be taken in during low rotational speeds, is no longer affected by the position of the throttle flap from an already relatively low throttle flap angle, it is of advantage to design the position threshold value FPSU in dependence on rotational speed. The threshold value can be, for example, about 27° at about 1200 rpm, about 40° at 2000 rpm, about 60° at 3000 rpm and about 70° at 4000 rpm. The values to be used in the actual case, however, depend greatly on the throttle flap cross section and the volume of the internal combustion engine. If the position threshold value FPSU were not to be shifted towards lower throttle flap angles with decreasing rotational speed, the consequence would be absence of no increased fuel supply and, thus, no increased rotational speed when the accelerator pedal is moved further from the value from which a further opening of the throttle flap has no further effect on the air volume which can be taken in. Exactly such an increase in fuel supply and in torque, however, occurs when switch-over from lean operation to stoichiometric operation already occurs at the said threshold value.

In the adjusting system according to the embodiment, the control means 15 is present. An adjusting means having the characteristics described above can also be used, however, in an internal combustion engine which is not controlled by closed-loop control but only by open-loop control.

It is again pointed out that the basic concept of the invention lies in the fact of switching from lean operation to stoichiometric operation and conversely when changing from the lower to the upper load range. This change must be carried out at least during steady-state operation, that is to say when it is found, after changing from the lower to the upper load range or conversely, that there is no further greater change in the accelerator pedal after a certain time interval has elapsed. A transition from one operating mode to the other, however, is advantageously made dependent on the condition that steady-state operation has set in and the transition is advantageously not carried out abruptly but in accordance with a controlling-down function from stored table values or in accordance with a mathematical function.

It is pointed that the term accelerator pedal is generally understood to be a device for adjusting the torque desired by a vehicle operator. In a motor vehicle for handicapped persons it can be, for example, a manually adjustable lever. It is furthermore pointed out that the term throttle flap is generally understood to be the adjusting member for the volume of air which can be taken in. In this sense, throttle flap can be an auxiliary flap which is adjusted independently of the actual throttle flap by means of an auxiliary intake duct and which is directly coupled to the accelerator pedal.

The respective period of four computing cycles corresponding to four engine cycles was mentioned as time intervals for determining whether steady-state operation occurs and for performing the transition from lean to stoichiometric operation or conversely. However, these time intervals can be selected to be different and in each case predetermined between 0 and a greater number of cycles if the operation is carried out with the aid of a microcomputer, depending, for example, on the respectively required smooth running behaviour of an internal combustion engine present in each case. For internal combustion engines having special characteristics, it can also be of advantage to design the time intervals to be dependent on rotational speed, particularly to use an increasing number of cycles with increasing rotational speed which, however, can lead to a shortening of the time interval in spite of the increase in cycles.

While the invention has been illustrated and described as embodied in a method and a system for adjusting the lambda value of an air/fuel mixture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A method of adjusting a lambda value of an air-fuel mixture to be supplied to an internal combustion engine of a motor vehicle having an accelerator pedal, the internal combustion engine having a throttle flap actuator, said method comprising the step of adjusting the throttle flap actuator in accordance with a respective value of an accelerator pedal position signal in such a manner that an air volume to be supplied to the internal combustion engine provides for obtaining a lean air-fuel mixture when the respective value of the accelerator pedal position signal is below a threshold value of the accelerator pedal position signal, that is when the accelerator pedal is in a position corresponding to a lower load range of the internal combustion engine, and for obtaining a stoichiometric air-fuel mixture, at least during steady-state operation, when the respective value of the accelerator pedal position signal is above the threshold value of the accelerator pedal position signal, that is when the accelerator pedal is in a position corresponding to an upper load range of the internal combustion engine.

2. A method as set forth in claim 1, wherein a transition from a lean operation to a stoichiometric operation and conversely is effected when a fluctuation of the accelerator pedal position signal drops below a predetermined fluctuation range of the accelerator pedal position signal with a predetermined time interval.

3. A method as set forth in claim 1, wherein the threshold value of the accelerator pedal position signal is selected to be dependent on a rotational speed of the internal combustion engine in such a manner that the threshold value is substantially such that further opening of a throttle flap does not result in any further significant increase in an air volume admitted at a respective rotational speed.

4. A method as set forth in claim 1, wherein said adjusting step includes adjusting of a throttle flap by rotational speed-dependent values when the threshold value of the accelerator pedal position signal is exceeded.

5. A system for adjusting a lamba value of an air-fuel mixture to be supplied to an internal combustion engine of a motor vehicle having an accelerator pedal, the internal combustion engine having a throttle flap actuator, said adjusting system comprising means for adjusting the throttle flap actuator in accordance with a respective value of an accelerator pedal position signal in such a manner that an air volume to be supplied to the internal combustion engine provides for obtaining a lean air-fuel mixture when the respective value of the accelerator pedal position signal is below a threshold value of the accelerator pedal position signal, that is when the accelerator pedal is in a position corresponding to a lower load range of the internal combustion engine, and for obtaining a stoichiometric air-fuel mixture, at least during steady-state operation, when the respective value of the accelerator pedal position signal is above the threshold value of the accelerator pedal position signal, that is when the accelerator pedal is in a position corresponding to an upper load range of the internal combustion engine.

6. An adjusting system as set forth in claim 5, wherein said adjusting means includes comparator means for effecting a transition from a lean operation to a stoichiometric operation and conversely when a fluctuation of the accelerator pedal position signal drops below a predetermined fluctuation range of the accelerator pedal position signal within a predetermined time period.

7. An adjusting system as set forth in claim 5, wherein said adjusting means includes transition means for effecting a gradual transition within a predetermined time period from a lean operation to a stoichiometric operation and conversely.

8. An adjusting system as set forth in claim 5, wherein said adjusting means includes an adjusting signal memory for storing a set of adjusting values for lean and stoichiometric operations retrievable by values of the accelerator pedal position signal.

9. An adjusting system as set forth in claim 5, wherein said adjusting means comprises means for outputting an adjusting signal for adjusting the throttle flap actuator for a stoichiometric operation, a lambda value being controlled to 1 during a time interval in which the adjusting signal is output.

10. An adjusting system as set forth in claim 9, further comprising control means for additionally controlling the lambda value to a lean value predetermined according to values of operational variables during time intervals in which said adjusting means outputs adjusting signal for adjusting the throttle flap actuator to a lean operation position.

* * * * *